United States Patent [19]

Evans

[11] 4,226,284

[45] Oct. 7, 1980

[54] GAS WELL DEWATERING METHOD AND SYSTEM

[76] Inventor: Jack E. Evans, 5804 Ravella Dr., Farmington, N. Mex. 87401

[21] Appl. No.: 917,933

[22] Filed: Jun. 22, 1978

[51] Int. Cl.[3] ..... E21B 43/12

[52] U.S. Cl. ..... 166/64; 166/53; 166/75 R; 166/311; 166/314; 166/267

[58] Field of Search ..... 166/311, 314, 53, 64, 166/75 R, 267

[56] References Cited

U.S. PATENT DOCUMENTS

| | | | |
|---|---|---|---|
| 528,449 | 10/1894 | Staley | 166/267 |
| 2,061,865 | 11/1936 | Wells | 166/314 |
| 3,266,574 | 8/1966 | Gandy | 166/64 X |

*Primary Examiner*—William F. Pate, III

*Attorney, Agent, or Firm*—Walter R. Keller

[57] ABSTRACT

A method and system for dewatering gas wells on an intermittent, cyclical, period which operates to eject water from the well without loss of gas from the well, or inordinate shut down delays. The said method and system for dewatering gas wells includes time controlled valves and the pressure differential between the tubing and the casing to periodically dewater the well, without the ususal loss of gas.

2 Claims, 2 Drawing Figures

GAS WELL DEWATERING METHOD AND SYSTEM

BACKGROUND

1. Field of the Invention.

This invention relates to automatic systems for removing liquids from gas producing wells.

2. Description of Prior Art.

Gas wells often produce liquid in addition to the desired gas. This liquid is normally water, but may be oil or a hydrate. The liquid enters the well casing along with the gas from the surrounding formation. When production pressures are low, significant quantities of liquids accumulate at the bottom of the casing, and may significantly reduce or even shut down gas flow from the well. The casing pressure is greater than the tubing pressure and present methods usually operate on this pressure differential. However, present systems use the pressure differential to determine when and how long to dewater the well, and invariably during the dewartering process the well is vented to the atmosphere, allowing the loss of substantial amounts of gas to the atmosphere. GANDY, U.S. Pat. No. 3,266,574 uses a timer in conjunction with a pressure defferential sensor to determine when and how long to dewater the well, but the liquid discharge and gas entrained or trapped therewith escapes. Furthermore, GANDY is much more complicated, then the present invention, thus demanding more maintainence. The present invention has the advantages of simplicity, virtually no maintainency, and savings of gas.

SUMMARY

The invention comprises a timed dewatering system wherein the casing pressure is utilized to dewater by permitting the liquid and entranced gas to pass into the normal gas flow line and the usual liquid separator system. It is one objective of the invention to allow the well to produce gas at its most efficient rates, and to eject the water without loss of gas.

It is also an object of the present invention. to provide an improved automatic gas well dewatering system which overcomes the prior art deficiencies; which is simple, economical, and reliable.

It is further the object of the present invention to provide an improved gas well dewatering system which has easy surface accessibility; which can compliment present measuring equipment, and which is simple and easy to install and adjust

DESCRIPTION OF THE PREFERRED EMBODIMENT

Figure 1:
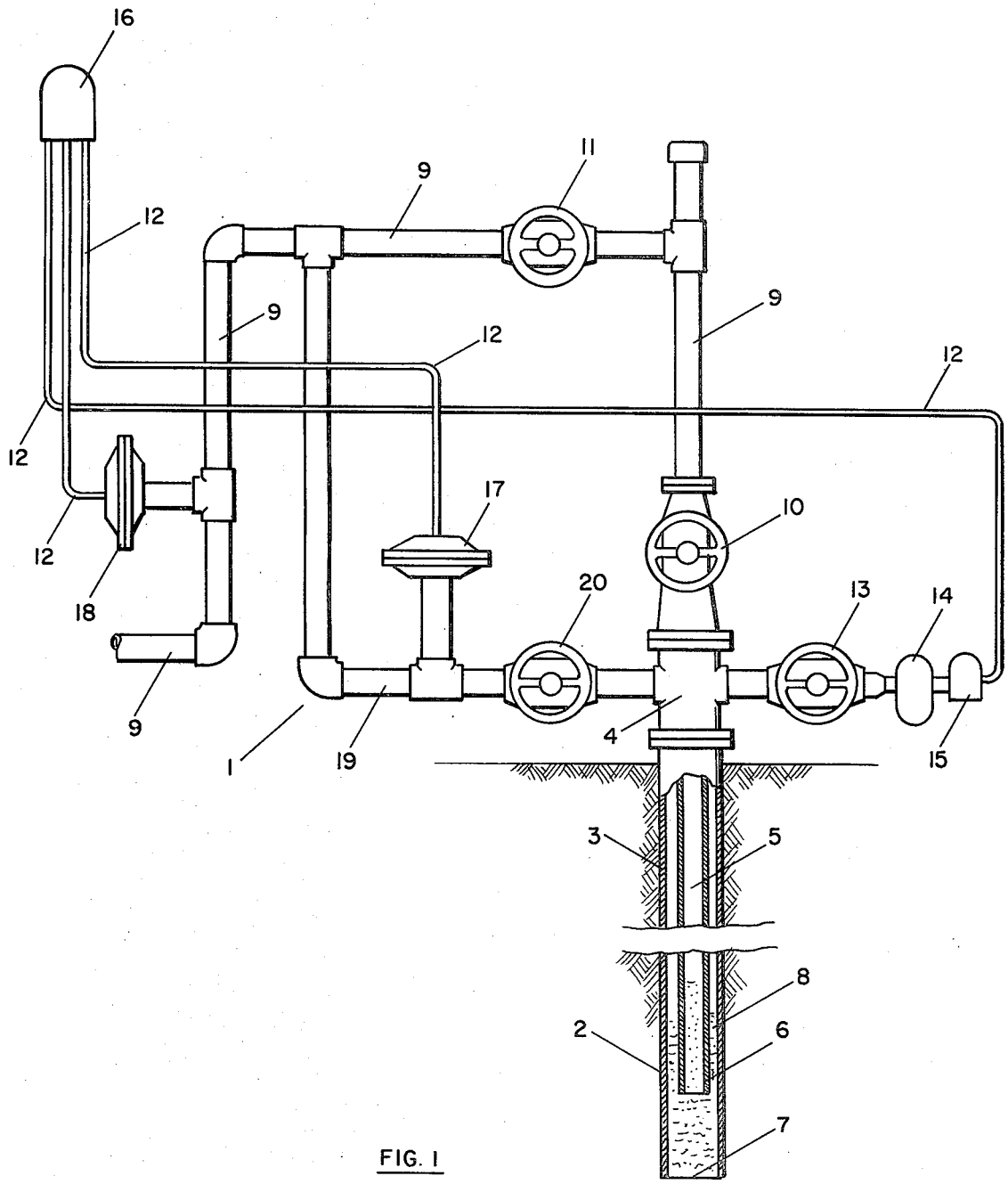
FIG. 1 is a schematic illustration of an automatic gas well dewatering system embodying the present invention.

In the illustrated embodiment of the invention shown in FIG. 1, the automatic gas well dewatering system 1 is used with a gas well 2, having a conventional casing 3, head 4, and tubing string 5 extending through the casing 3 with its open perforated lower end as at 6 in sufficient proximity to the bottom 7 of the well bore to enable the gas flowing into the wellbore from the formation to be accessible to the lower end of the tubing string 5, until such time as liquid as at 8 has accumulated in the bottom of the well bore to a sufficient depth to outweigh the pressure of the well bore thus cutting off or reducing the flow rate of gas through the tubing string 5 to a flow line 9.

In a normally producing gas well 2, gas flows up through the tubing string 5, through main shut off valve 10, a second shut off valve 11, and out the flow line 9 into a main line, not shown which has a liquid separator The invention comprises a casing pressure bleed line 12 having a shut off valve 13, a first gas regulator 14, and a second gas regulator 15, the casing pressure bleed line 12 then connects to a timer 16 which in turn is connected to a normally closed motor valve 17 and a normally open motor valve 18. The invention further comprises a blow-back line 19, which contains a shut off valve 20 and the normally closed motor valve 17, the blow back line 19 connecting to the flow line 9. Down stream, in the flow line 9, from the junction of the flow line 9, and the blow-back line 19 is placed the normally open motor valve 18.

At the pre-set time, for a predetermined interval, the normally open motor valve 18 is closed, and the normally closed motor valve 17 is opened. This allows the greater pressure in the casing 3 to flow through the blow-back line 19, through the normally closed motor valve 17, and down the tubing string 5, thus changing the bottom of the well 2. At the desired time at the end of the predetermined interval, the normally open motor valve 18 is opened, the normally closed motor valve 17 is closed, and gas and the entrained liquid 8 are expelled as in natural gas flow, and the liquid is collected in the liquid separator on main line, not shown.

The invention uses standard commercially available components. All piping and pipe fittings are naturally standard. The normal open motor valve 18 is readily available such as model 536 BGA-9A.A, 2 inch body size, from Normal Corporation, Norris Division, Houston, Texas. The normally closed motor 17 is available in the 2 inch body size, 1 from Dressen 0.M.E., Dallas Tex. First Gas Regulator 14, a first cut regulator is MECO P-125 regulator and the second gas regulator 15, a second cut regulator, is a Fisher 67R regulator.

Figure 2:
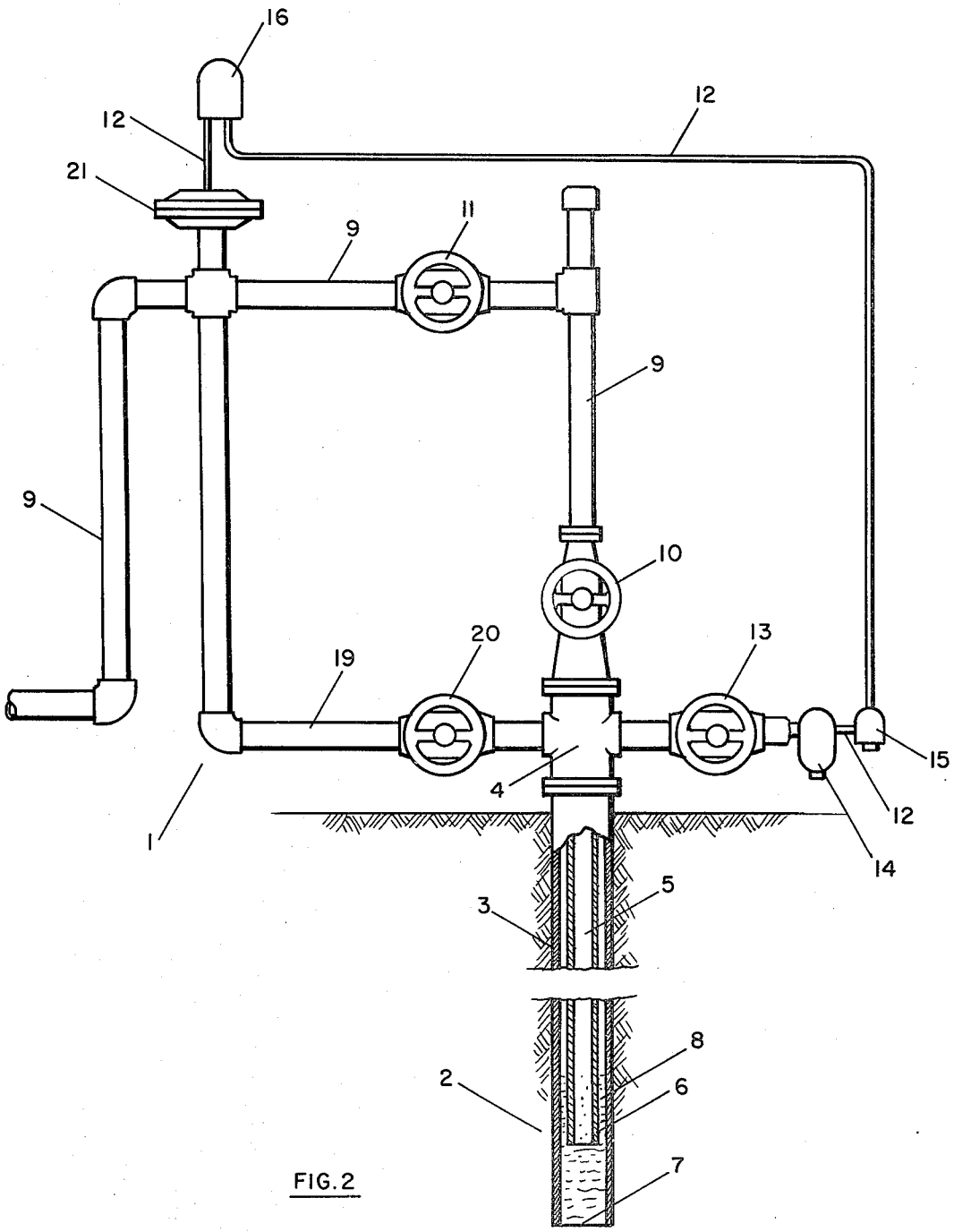
FIG. 2 is a schematic illustration of an automatic gas well dewatering system embodying an alternative configuration of the present invention.

FIG. 2 shows an alternative configuration of the invention. In the alternative configuration, a three-way motor valve 21 is installed at the junction of flow-line 9 and the blow back line 19, instead of a normally open motor valve 18 and a normally closed motor valve 17. The three-way motor valve 21 is of standard construction and is commercially available from Fisher Controls Co., Marshalltown, Iowa model type 657-YY. At the desired time and for a desired interval, the greater casing pressure is channeled down the tubing string 5, and the normal gas flow through flow line 9 is discontinued. At the termination of the desired interval the casing pressure is closed off by the three way motor valve 21; and the liquid and entrained gas flows through the flow-line 9 to the main line and liquid separator, not shown.

I claim:

1. In an gas well having a casing and tubing string in which liquid collection at the bottom of the well interferes with gas production, a system for shutting off the normal flow of gas, and directing the greater casing pressure down the tubing string as desired intervals that comprises a blow-back line connecting the well casing to a flow line said flow line through which the gas from a normally producing well passes; said blow-back line having a shutoff valve, a normally closed motor valve; a normally opened motor valve in the flow line down stream from the junction of the flow line and the blow-back line; a timer connected by a bleed line to the well head, said bleed line having a shut off valve and first gas regulator and a second gas regulator, said bleed line further connecting from the timer to the normally closed motor valve, and normally opened motor valve.

2. In a gas well having a casing and tubing string in which liquid collection at the bottom of the well interferes with gas production, a system for shutting off the normal flow of gas and directing the greater casing pressure down the tubing string at desired intervals comprises a blow-back line connecting the well casing to a flow line said flow line being that through which the gas from a normally producing well passes; said blow-back line having a shut-off valve, a three way motor valve in the junction of the blow-back line and the flow line, a timer connected by a bleed line to the well head, said bleed line having a shut-off valve and a first gas regulator and a second gas regulator, said bleed line further connecting from the timer to the three way motor valve.

* * * * *